US008435067B2

(12) United States Patent
Wegener

(10) Patent No.: US 8,435,067 B2
(45) Date of Patent: May 7, 2013

(54) COMPUTER CABLE CONNECTOR PROTECTOR

(76) Inventor: David Wegener, Columbia, SC (US)

( * ) Notice: Subject to any disclaimer, the term of this patent is extended or adjusted under 35 U.S.C. 154(b) by 265 days.

(21) Appl. No.: 12/876,714

(22) Filed: Sep. 7, 2010

(65) Prior Publication Data

US 2010/0330837 A1 Dec. 30, 2010

(51) Int. Cl.
*H01R 13/58* (2006.01)

(52) U.S. Cl.
USPC ..... 439/465; 439/445; 439/459; 439/904; 439/906

(58) Field of Classification Search ..... 439/445, 439/459, 461, 465, 904, 906
See application file for complete search history.

(56) References Cited

U.S. PATENT DOCUMENTS

| | | | | |
|---|---|---|---|---|
| 1,039,670 | A * | 9/1912 | Gagnon | 439/450 |
| 3,879,571 | A * | 4/1975 | Reed | 174/662 |
| 4,224,465 | A * | 9/1980 | Ruzic | 174/135 |
| H113 | H * | 8/1986 | McNeel | 439/282 |
| 5,533,911 | A * | 7/1996 | Elam | 439/459 |
| 5,601,447 | A * | 2/1997 | Reed et al. | 439/404 |
| 5,658,170 | A * | 8/1997 | Tan et al. | 439/607.41 |
| 5,836,784 | A * | 11/1998 | De Oliveira et al. | 439/502 |
| 5,971,792 | A | 10/1999 | Lin | |
| 6,338,644 | B1 * | 1/2002 | Fritzinger et al. | 439/445 |
| 6,361,357 | B1 | 3/2002 | Stillwell | |
| 6,475,021 | B1 * | 11/2002 | Tan et al. | 439/446 |
| 6,517,368 | B2 * | 2/2003 | Hara et al. | 439/271 |
| 6,910,914 | B1 * | 6/2005 | Spink, Jr. | 439/497 |
| 6,979,223 | B2 * | 12/2005 | Chen | 439/490 |
| 7,163,424 | B2 * | 1/2007 | Dancel et al. | 439/731 |
| 7,249,962 | B2 * | 7/2007 | Milette et al. | 439/425 |
| 7,311,526 | B2 * | 12/2007 | Rohrbach et al. | 439/39 |
| 7,867,040 | B2 * | 1/2011 | Yu et al. | 439/701 |
| 2001/0053624 | A1 * | 12/2001 | Medina et al. | 439/404 |
| 2003/0228783 | A1 * | 12/2003 | Cairns et al. | 439/204 |
| 2004/0077199 | A1 * | 4/2004 | Winstead et al. | 439/165 |
| 2008/0207021 | A1 * | 8/2008 | Hsu et al. | 439/79 |
| 2009/0117785 | A1 * | 5/2009 | Wu | 439/668 |
| 2010/0330837 | A1 * | 12/2010 | Wegener | 439/456 |

FOREIGN PATENT DOCUMENTS

| | | |
|---|---|---|
| JP | 06-295765 | 10/1994 |

* cited by examiner

*Primary Examiner* — James Harvey
(74) *Attorney, Agent, or Firm* — Michael A. Mann; Nexsen Pruet, LLC

(57) ABSTRACT

A device and method for reinforcing a connector and a portion of cable adjacent to the connector is herein disclosed and claimed. The device of the present invention is comprised of a body that grips and secures a connector and a portion of cable adjacent to the connector. The body has a longitudinal passage therethrough, the passage having a first section and a second section. The first section is dimensioned to receive the connector and the second section is dimensioned to receive the portion of cable. The body may be comprised of two corresponding clam shell halves which can be fastened together using common fasteners, joined with an adhesive, or otherwise frictionally or chemically joined. The body may also be injection molded around the connector and cable.

11 Claims, 4 Drawing Sheets

COMPUTER CABLE CONNECTOR PROTECTOR

CROSS REFERENCE TO RELATED APPLICATIONS

This application claims priority to the provisional applications bearing Ser. Nos. 61/033,658 filed 3 Mar. 2008, 61/042,372 filed 4 Apr. 2008, and 61/079,910 filed 11 Jul. 2008, and to PCT/US2009/036039 filed 4 Mar. 2009.

STATEMENT REGARDING FEDERALLY SPONSORED RESEARCH OR DEVELOPMENT

Not Applicable.

REFERENCE TO A SEQUENCE LISTING, A TABLE, OR A COMPUTER PROGRAM LISTING COMPACT DISC APPENDIX

Not applicable.

BACKGROUND OF THE INVENTION

Apple Computer, Inc. was awarded U.S. Pat. No. 7,311,526 on Dec. 25, 2007 for a power adapter for a computer. In particular, the adapter uses a magnet to connect to a personal computer's universal serial bus (USB), as seen in FIG. 1. The adapter connector and cable are designed to secure and protect the electronic power cable of an Apple computer charger assembly known as a MAGSAFE™ Power Adapter.

The problem with this device, as well as others like it, is shown in FIG. 2. The cable tends to break easily adjacent to the connector. Severe and potentially dangerous damage can occur when the cable, which contains live powered wires, is subjected to the stress of being plugged into and unplugged from a computer. The force on the cable can cause the wire points to either tear loose from the circuit board inside the connector or to break, causing the circuits to open or to short against each other. The type of problem seen in the MAGSAFE™ Power Adapter is not limited to that particular product, however. It is common for cables to be ripped from or otherwise loosened from the connectors to which they are joined.

Moreover, the shape and size of many connectors encourages the user to grab the cable or the cable along with the connector to unplug the adapter. The repeated stresses on the cable, which typically have a somewhat flexible insulation, causes the insulation to pull away from the connector, the cable to pull out of the connector, and the wires inside the cable to be exposed or to be shorted to one another.

Thus, there remains a need for a device that supports and protects computer cables and connectors by immobilizing (with respect to the connector) the portion of the cable that is adjacent to the connector and allowing the user to easily grip the connector without gripping the cable.

SUMMARY OF THE INVENTION

The present device is comprised of a molded body that can be a single piece, two halves, or multiple pieces. The body is dimensioned to receive, grip, and support the connector and a portion of cable adjacent to the connector. By gripping the connector and the cable, the device prevents the portion of the cable adjacent to the connector from moving with respect to the connector. The body is also larger than the connector and therefore easier to grip in order to unplug the connector. In one embodiment of the present invention, the body has concave sides that provide the user with a comfortable gripping surface for unplugging the adapter. These features minimize the risk that the user will pull directly on the cable and thereby reduced the likelihood of this common structural failure seen in FIG. 2.

The body of the device can be made to grip the connector and cable in any number of ways. For example, the body may be chemically bonded to the current cable and block assembly. Alternatively, the body could be compressed around the connector and cable or injection-molded over them. Also, the body could be secured to the original connector and cable using common fasteners.

The portion of the body designed to house the cable is specifically designed to grip the cable to immobilize it with respect to the connector and thereby transfer tension on the cable to the body. For example, the diameter of the passage in the body through which the cable travels can be slightly smaller than the diameter of the cable, thereby compressing and gripping the cable. The passage for the cable can have one or more curves defining a "serpentine" path to increase the friction between the body and the cable. In additional embodiments, a chemical agent or agents, such as an adhesive, or surface features on the passage can by used to provide better grip by the body on the cable.

Because many connectors have a multi-colored indicator light therein, the body of the present invention is made of transparent materials through which the light from the indicator may pass. As an alternative, the body can have a small hole or viewing window through which the indicator light can be seen.

The present invention removes or reduces strain from the point of connection between the wiring within the cable and the circuitry inside the connector. The size of the device (necessarily larger than the original connector) also adds an element of mechanical advantage. The present device is longer than it is wide, creating mechanical advantage when it is to be removed. This advantage results in less stress on the cable, preventing it from being broken at the end of the connector and easier disconnection. In addition, the larger size means that it is easier to unplug the connector without grabbing and using the cable. Moreover, the friction between the cable and the body of the present invention allows the present invention to absorb the stresses applied to the cable before those stresses are fully applied to the connector.

DETAILED DESCRIPTION OF THE INVENTION

The present invention relates generally to computer cables and specifically to reinforcements for the junction between the cable and the connector. This device, which covers and grips the connector and a portion of the cable, secures the cable vis-à-vis the connector so that the connection between the wires in the cable and the circuit board in the connector is insulated from stresses placed on the portions of the cable outside of the device.

Figure 1:
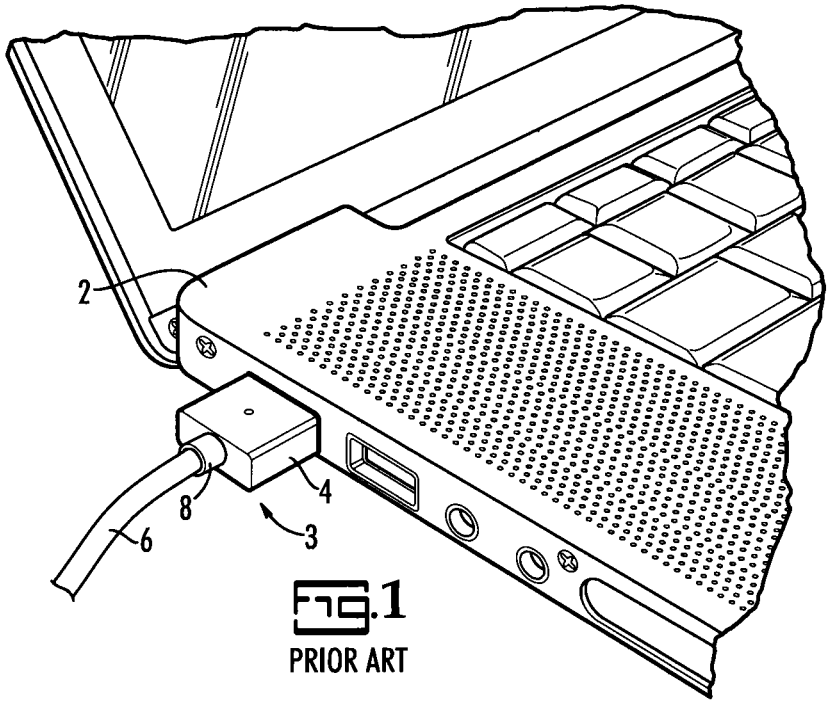
FIG. 1 PRIOR ART
FIG. 1 is a perspective view of a power adapter of the prior art connected to a laptop.
Figure 2:
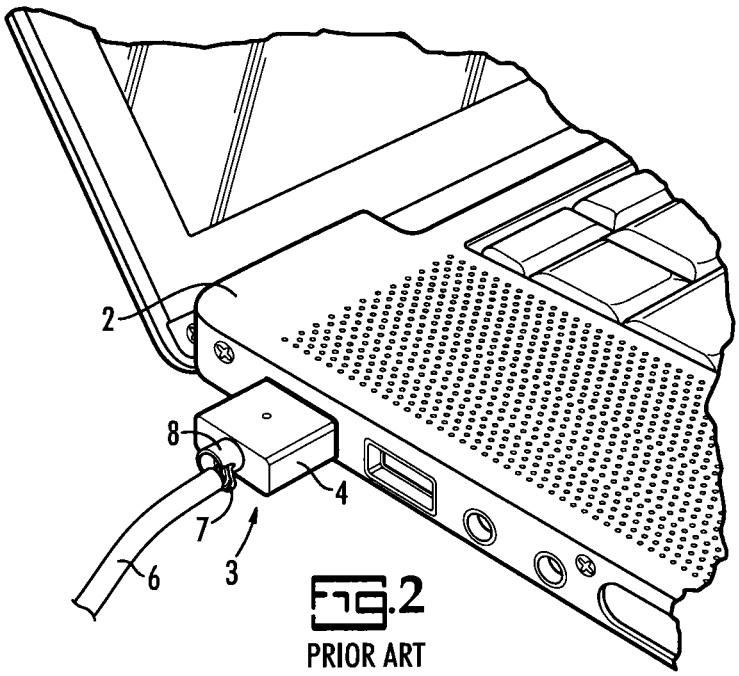
FIG. 2 PRIOR ART
FIG. 2 is a perspective view of a broken power adapter of the prior art connected to a laptop.

FIGS. 1 and 2 show a power adapter 3 plugged into a laptop computer 2. Note that the power adapter 3 is comprised of a connector 4 and a cable 6. Attached to the connector 4 and extending over a small portion of the cable 6 is a collar 8. Collar 8 is designed to prevent cable 6 from being ripped from connector 4 but is ineffective. As seen in FIG. 2, notwithstanding the collar 8, cable 6 can be easily torn out of connector 4, when torn out of connector 4, exposes and stretches the wires 7 inside cable 6.

Figure 3:
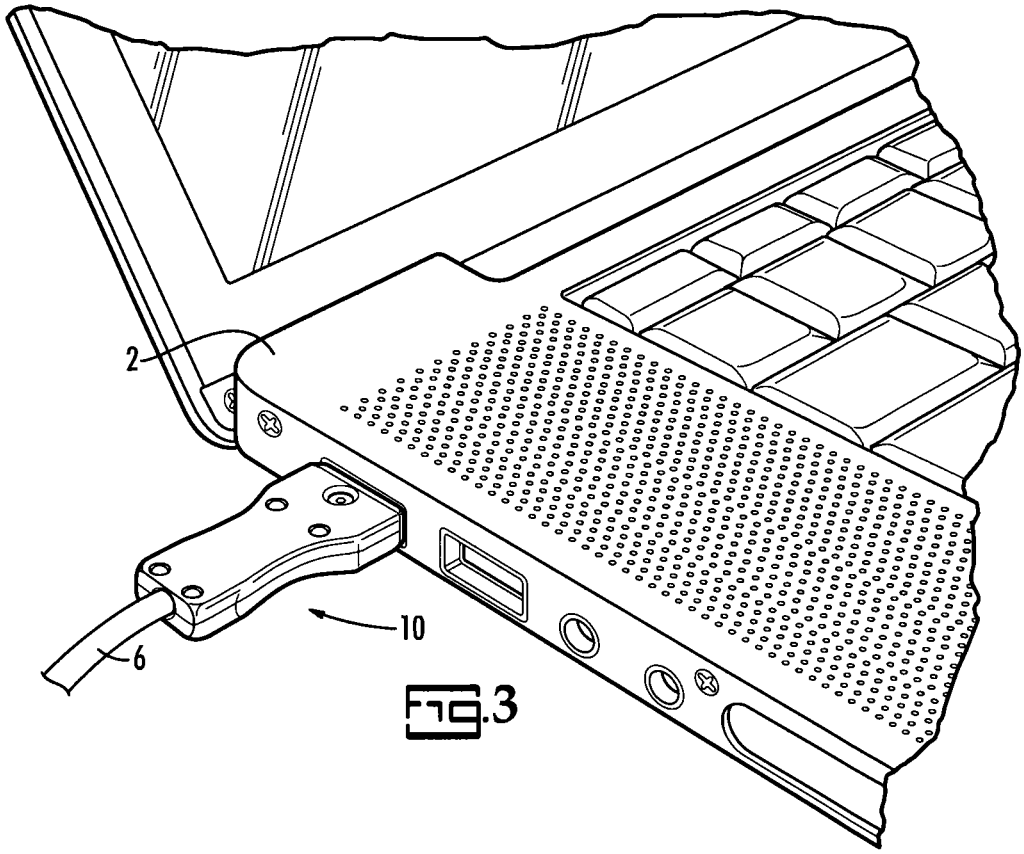
FIG. 3 is a perspective view of one embodiment of the device of the present invention installed on a connector and cable and plugged into a laptop computer.
Figure 4:
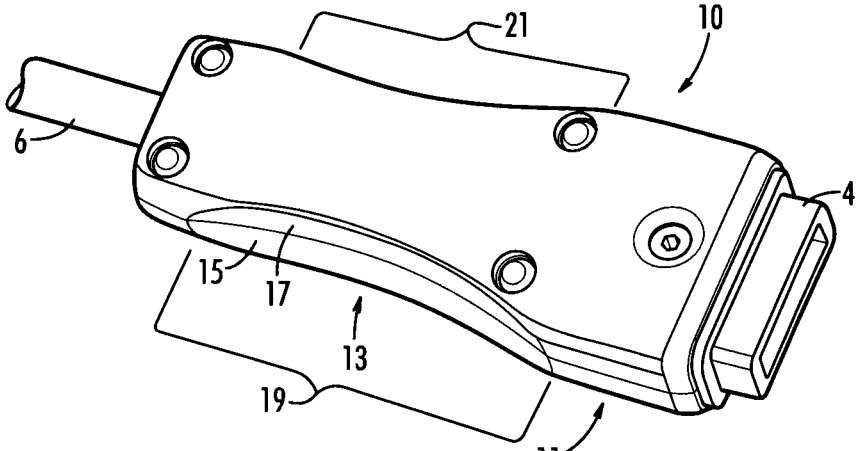
FIG. 4 is a perspective detail of one embodiment of the device of the present invention installed on a connector and cable.

FIG. 3 shows one embodiment of the present invention 10 installed on a cable and connector that is plugged into a laptop 2. Connector 4 is largely obscured by the device but cable 6 is seen exiting the rear of the device 10. FIG. 4 is a detail of one embodiment of the present invention installed on a cable and connector. A portion of connector 4 can be seen extending from a first end 11 of the device. Cable 6 exits the second end 13 of the device 10. This particular embodiment is comprised of two halves formed so as to correspond to each other internally and externally when brought together as in the fashion of the two parts of a clam shell, and referred to herein as clam shell halves 15 and 17. Note also that this embodiment of the present invention 10 has concave gripping surfaces 19 and 21 that provide a large and inviting gripping surface for manipulating (plugging and unplugging) the connector.

Importantly, device 10 makes connector 4 longer, so the combined device 10 and connector 4 is longer than it is wide, resulting in a significant improvement in mechanical advantage available to the person removing it from a computer. So, not only is connector larger and shaped for better gripping, but, because device 10 makes the combined device-and-connector longer than connector 4 is wide, it is easier to remove.

Figure 5:
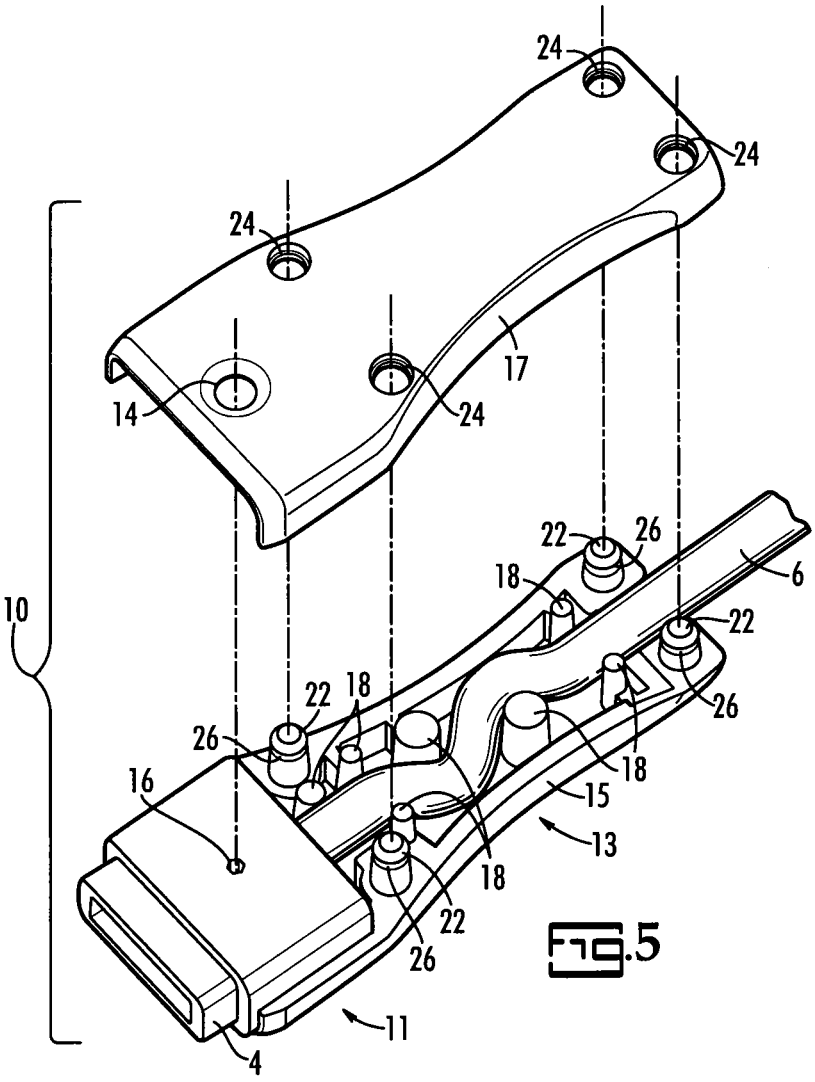
FIG. 5 is a perspective view of one embodiment of the present invention showing the guideposts inside the body.

FIG. 5 shows one embodiment of the present invention 10 with one of the clam shell halves 17 elevated from the other half 15 so that the inside of the device 10, including the longitudinal passage through the first section 11 and second section 13, can be seen. Note that the passage in the first section 11 of the device 10 is dimensioned to grip connector 4. Note also that the top clam shell half 17 has a visual access hole 14 through which indicator light 16 is visible when the clam shell half 17 is placed on connector 4. Alternatively, the device 10 could be made of transparent plastic, thereby obviating the need for the visual access hole 14.

The longitudinal passage in the second half 13 of this particular embodiment contains guideposts 18 that define a serpentine path for the cable 6. The serpentine path increases the friction between the second half 13 of the device 10 and the cable 6, which insulates the connector 4 from stresses imposed on the portion of cable 6 that is outside the device 10. Note also that the device 10 is much longer than the connector 4. Because of the small size of the connector 4, when attempting to unplug the connector 4 from a computer without the aid of the present invention 10, the user inevitably grabs the cable 6 in addition to the connector 4. This stress on the cable 6 leads to the separation of the cable 6 from the connector 4 as seen in FIG. 2. The present invention 10 is substantially longer than the connector 4 is wide, affording the user ample room to grip the device 10 to remove the connector 4 from a computer without pulling on the cable 6.

Figure 6:
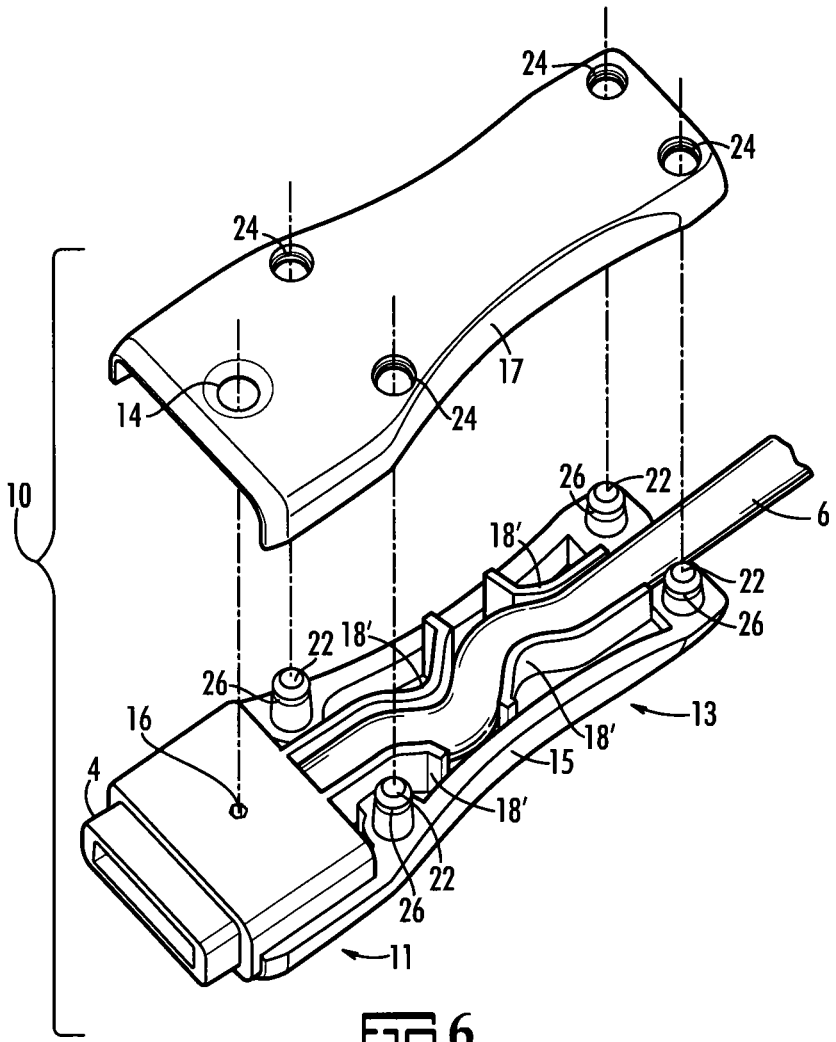
FIG. 6 is a perspective view of one embodiment of the present invention showing the channel inside the body.

The embodiment of the present invention 10 shown in FIG. 6 is similar to the embodiment in FIG. 5 with one exception. In FIG. 5, guideposts 18 define the serpentine pathway for the cable 6. In FIG. 6, a serpentine channel 18' defines the pathway for cable 6. The serpentine channel 18' in FIG. 6, like the pathway defined by the guideposts 18 in FIG. 5, serves to increase friction between the cable 6 and the second half 13 of the device 10.

Other options rather than a serpentine path can be substituted, such as a drop-in clamping system whereby a loose "cam" is used to grip the cable and prevent movement by means of compression against a serpentine-shaped area's retaining post.

In the embodiment of the device 10 shown in FIGS. 5 and 6, the bottom half 15 of the device 10 has four friction posts 22 at the four corners of the second half 13. In the top half 17, there are four corresponding holes 24 dimensioned to receive and engage the friction posts 22. These posts 22 and holes 24 allow the top and bottom halves 17 and 15 to be joined together. Specifically, the friction posts 22 in the bottom half 15 have annular detents 26. While the friction posts 22 are slightly larger in diameter than the holes 24, the diameter of the portion of friction posts 22 at the annular detent 26 is closer to the diameter of the holes 24 than is the diameter of the rest of friction post 22. Accordingly, the friction posts 22 can be forced into the holes 24 until they holes 24 snap into place around annular detents 26.

Alternatively, top and bottom halves 17 and 15 could be joined with an adhesive, or with common fasteners such as screws, including machine screws. In addition, a bolt and screw could be used to secure the halves 17 and 15 and the nut could reside in a recessed area dimensioned to receive the nut so that it does not protrude from the device 10. Regardless of the fastening method, top and bottom halves 17 and 15 can have any combination of projections and recesses (including recesses in the form of holes) to assist in lining up the two halves.

Note that the present invention 10 also serves as a coupler between the hands of the user and the connector 4. The present invention's role as a coupler serves two objectives, among others. First, the size of the present invention makes it a convenient and inviting "handle" for manipulating the connector 4. The present invention 10 is larger than the connector 4 and, when equipped with concave gripping surfaces 19 and 21, provides a convenient and comfortable means for plugging and unplugging the connector 4. Second, the friction between the present invention 10 and the cable 6 allows stresses imposed on the cable 6 to be absorbed by the present invention 10 before being fully transferred to the connector 4. In this sense, the present invention 10 acts as a buffer insulating the connector 4 from the stresses imposed on the cable 6.

The end of device 10, where cable 6 exits, is preferably chamfered so as to afford relief to cable 6 from pinching, and thereby also allowing latitudinal pressure on cable 6 to be converted evenly into longitudinal pull, thereby preventing cable 6 from becoming damaged where it exits device 10.

The present invention is also a method of reinforcing a connector and cable. The invention comprises the steps of providing a body with a passage therethrough, the body having a first section and a second section, the first section dimensioned to receive and grip a connector and the second section dimensioned to receive and grip a cable, the body being comprised of two separate clam shell halves, placing the clam shell halves around the connector and securing them to one another so that the portion of the cable in the device cannot move with respect to the connector. Additional embodiments of the method of the present invention include attaching the clam shell halves with screws, adhesives (e.g., cyanoacrylate based adhesives and two-part epoxies), screws and bolts, as well as injection molding the device (e.g., thermoplastic or thermosetting materials) around the connector and cable inside a mold.

It will be apparent to those skilled in wiring and electronics that modifications and substitutions can be made to the foregoing preferred embodiments without departing from the spirit and scope of the present invention. For example, the connector box can be molded to be longer and incorporate the present device rather than have an over-mold or two-part mechanical clamp applied.

What is claimed is:

1. A device for protecting the junction between a connector and a cable, said device comprising: a body having a first end and an opposing second end defining a longitudinal axis, said body having a longitudinal passage therethrough, said passage having a first section at said first end and a second section at said second end, wherein said body is comprised of a first clam shell half and a corresponding second clam shell half, said first clam shell half and said second clam shell half each containing a half of said first section of said passage and a corresponding half of said second section of said passage, said first clam shell half having a plurality of projections emanating therefrom, said second clam shell half having a plurality of recesses therein, said recesses positioned and dimensioned to receive said projections so that said first clam shell half and said second clam shell half can be placed around a connector and said portion of said cable with said projections from said first clam shell half fitting into said recesses of said second clam shell half, said clam shell halves thereby gripping said connector and said portion of cable so that said connector and said portion of said cable cannot move with respect to one another, wherein said half of said second section in said first clam shell has a serpentine channel therein and wherein said half of said second section in said second clam shell has a corresponding serpentine channel therein, so that when said first and second clam shells are joined around said connector and said portion of said cable, said serpentine channels define a path for said portion of cable and said body acts as a buffer absorbing stresses placed on said portion of cable.

2. The device of claim 1 wherein said second section of said body contains a plurality of guideposts therein, said guideposts defining a serpentine path for said cable so that said body acts as a buffer absorbing stresses placed on said portion of cable before said stresses are fully applied to said connector.

3. A method of reinforcing a connector and a portion of cable adjacent to said connector, said method comprising the steps of: providing at least one screw; providing a body having a first end and an opposing second end defining a longitudinal axis, said body having a longitudinal passage therethrough, said passage having a first section at said first end of said connector and a second section at said second end of said connector, said first section dimensioned to receive and grip a connector, said second section dimensioned to receive and grip a portion of cable adjacent to said connector, said body comprised of a first clam shell half and a corresponding second clam shell half, said first clam shell half and said second clam shell half each comprising a half of said first section of said passage and a corresponding half of said second section of said passage, said body having at least one lateral hole therethrough, said at least one lateral hole extending through said first clam shell half and said second clam shell half and dimensioned to receive and engage said at least one screw; placing said first clam shell half and said second clam shell half around said connector and said portion of said cable; and attaching said first clam shell half to said second clam shell half with said at least one screw so that said first clam shell half and said second clam shell half grip said connector and said portion of cable securing said portion of cable with respect to said connector.

4. The device of claim 1 wherein said projections are friction posts with annular detents and said recesses are holes, said friction posts having a first diameter, said annular detents having a second diameter smaller than said first diameter, and said holes having a third diameter, said third diameter being greater than or equal to said second diameter but smaller than said first diameter so that when said first clam shell half and said second clam shell half are placed around said connector and said cable, said first clam shell half and said second clam shell half can be snapped together gripping said connector and said portion of cable so that said connector and said portion of cable cannot move with respect to one another.

5. A method of reinforcing a connector and a portion of cable adjacent to said connector, said method comprising the steps of: providing at least one screw; providing at least one nut dimensioned to engage said screw; providing a body having a first end and an opposing second end defining a longitudinal axis, said body having a longitudinal passage therethrough, said passage having a first section at said first end of said connector and a second section at said second end of said connector, said first section dimensioned to receive and grip a connector; said second section dimensioned to receive and grip a portion of cable adjacent to said connector, said body comprised of a first clam shell half and a corresponding second clam shell half, said first clam shell half and said second clam shell half each comprising a half of said first section of said passage and a half of said second section of said passage, said body having at least one lateral hole therethrough, said at least one lateral hole extending through said first clam shell half and said second clam shell half and dimensioned to receive said at least one screw; placing said first clam shell half and said second clam shell half around said connector and said portion of said cable; and attaching said first clam shell half to said second clam shell half with said at least one screw and said at least one nut so that said first clam shell half and said second clam shell half grip said connector and said portion of cable securing said portion of cable with respect to said connector.

6. The device of claim 1 , further comprising: at least one screw; and wherein said body has at least one lateral hole therethrough, said at least one hole extending through said first clam shell half and said second clam shell half so that said first clam shell half and said second clam shell half can be joined around said connector and said portion of cable with said at least one screw securing said portion of cable with respect to said connector.

7. The device of claim 6, further comprising: at least one nut; and wherein said second clam shell has at least one indentation therein, said indentation positioned around said at least one hole and dimensioned to receive said at least one nut so that said first clam shell half and second clam shell half can be joined around said connector and said portion of cable with said at least one screw and said at least one nut with said at least one nut residing within said indentation.

8. The device of claim 1 wherein said connector has a status light and said first section of said body has a viewing window therein positioned and dimensioned so that said status light is visible when said connector is in said first section of said body.

9. The device of claim 1 wherein said connector has a status light and said first section of said body is made of transparent plastic so that said status light is visible when said connector is in said first section of said body.

10. The device of claim 1 wherein said body has at least two exterior concave gripping surfaces, said gripping surfaces positioned on opposing sides of said body so that a user is invited to grip said body at said gripping surfaces.

11. The device of claim 1, wherein said body is longer than said connector is wide.

* * * * *

UNITED STATES PATENT AND TRADEMARK OFFICE

CERTIFICATE OF CORRECTION

PATENT NO. : 8,435,067 B2
APPLICATION NO. : 12/876714
DATED : May 7, 2013
INVENTOR(S) : David Wegener It is certified that error appears in the above-identified patent and that said Letters Patent is hereby corrected as shown below:

In the Specification (Column 1, Line 8) should read as follows:
Ser. Nos. 61/033,658 filed 4 Mar. 2008, 61/042, Signed and Sealed this
Seventeenth Day of September, 2013

Teresa Stanek Rea
*Deputy Director of the United States Patent and Trademark Office*